United States Patent [19]

Schmolke

[11] 4,272,865

[45] Jun. 16, 1981

[54] METHOD OF MAKING A BEATER ROLL

[75] Inventor: Karl H. Schmolke, Zwerenberg, Fed. Rep. of Germany

[73] Assignee: John D. Hollingsworth on Wheels, Inc., Greenville, S.C.

[21] Appl. No.: 25,030

[22] Filed: Mar. 29, 1979

Related U.S. Application Data

[62] Division of Ser. No. 918,484, Jun. 23, 1978, Pat. No. 4,208,767.

[51] Int. Cl.[3] ..... D01G 15/14

[52] U.S. Cl. ..... 19/97; 19/112; 29/121.4

[58] Field of Search ..... 19/97, 112; 29/121.1, 29/121.3–121.6; 57/58.93, 58.95

[56] References Cited

U.S. PATENT DOCUMENTS

| | | | |
|---|---|---|---|
| 1,688,418 | 10/1928 | Handcock | 19/97 |
| 3,968,542 | 7/1976 | Hollingsworth | 19/97 |

*Primary Examiner*—Louis Rimrodt

*Attorney, Agent, or Firm*—Bailey, Dority & Flint

[57] ABSTRACT

The invention relates to the method of making a beater roll comprising a body and a saw tooth wire helically fitted to the surface of the body wherein the helical convolutions are in spaced relation and wherein a sealant is employed to seal repetitive gaps or spaces between the base of the wire and the smooth cylindrical surface of the beater roll, such repetitive spaces or gaps being caused by placing the set necessary to accommodate wire clothing to the cylindrical surface of a roll as used in open end spinning.

1 Claim, 4 Drawing Figures

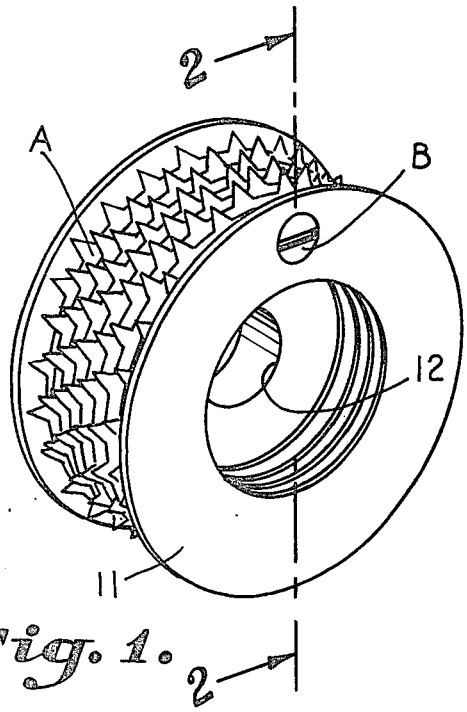
Fig. 1.
Fig. 3.
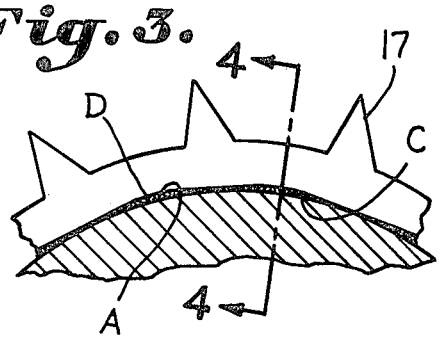
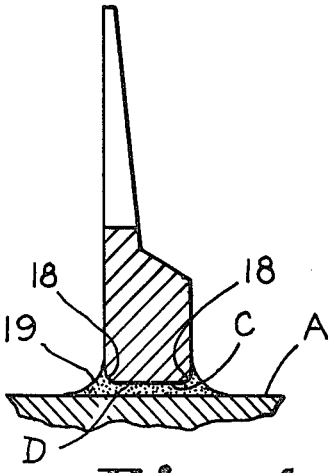
Fig. 4.
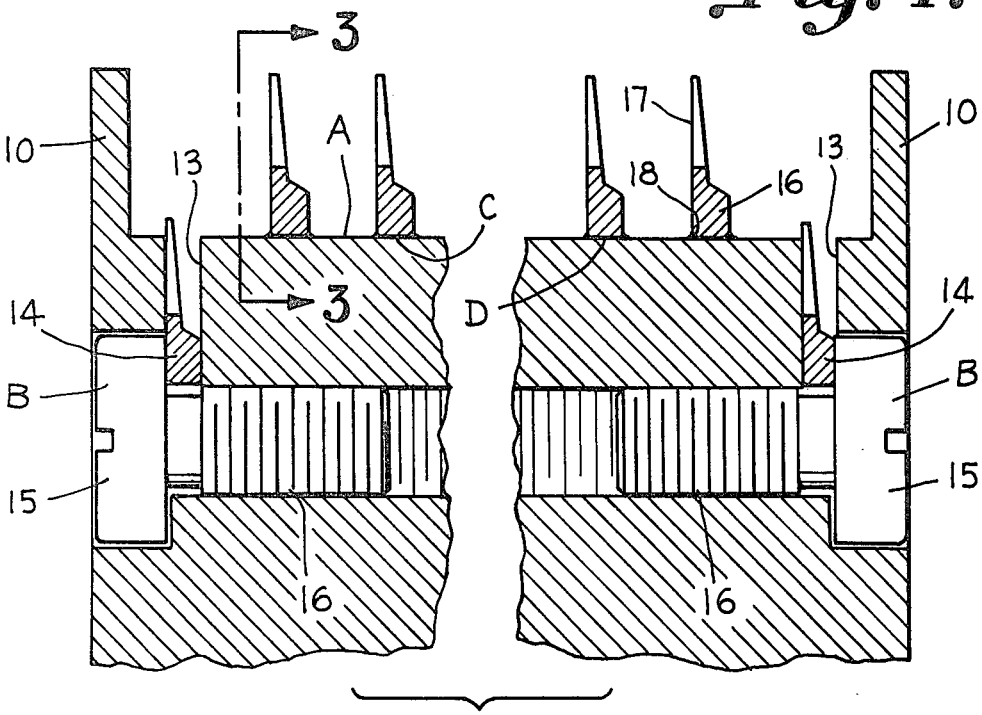
Fig. 2.

METHOD OF MAKING A BEATER ROLL

This is a division of application Ser. No. 918,484 filed June 23, 1978, now U.S. Pat. No. 4,208,767, granted June 24, 1980.

BACKGROUND OF THE INVENTION

The prior art encompasses U.S. Pat. No. 3,968,542 which is directed to a disposable roll which suggests the use of adhesive with contiguously wound metallic clothing. A metallic beater roll has been supplied wherein spaced convolutions of helically wound wire metallic clothing have been employed and removably secured at their ends as illustrated herein. However, such proved impractical in practice because of excessive loading and because of irregularities in the yarn produced by the collection and sloughing off of fibers due to entrapment within the voids or spaces formed beneath the base of the wire because of the set necessarily placed in the wire and because of the rounded base portions at the lower edges thereof. The prior art also encompasses the following patents: U.S. Pat. Nos. 631,992 and 2,849,844, and French Pat. No. 665,892 of May, 1929, as well as British Pat. Nos. 769,264 of March, 1957 and 854,090 of November, 1960.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein:

FIG. 1 is a perspective view illustrating a beater roll constructed in accordance with the present invention, FIG. 2 is an enlarged transverse sectional elevation taken on the line 2—2 in FIG. 1, FIG. 3 is a longitudinal sectional elevation taken on the line 3—3 in FIG. 2, and FIG. 4 is a transverse sectional elevation taken on the line 4—4 in FIG. 3 at an enlarged scale illustrating the meniscus formed by the sealant in sealing the repetitive spaces beneath the wire clothing of the beater roll.

DESCRIPTION OF A PREFERRED EMBODIMENT

The drawing illustrates a beater roll having metallic surface wound wire card clothing thereon for use in opening fibers in an open end spinning apparatus. The beater roll has a smooth cylindrical surface A carrying the card clothing thereon having a diameter on the order of about 2 to 3 inches. A set is placed on the metallic wire card clothing during the application of the clothing to the cylindrical surface. Means B removably secure each end of the metallic card clothing to the roll under sufficient tension to fasten the card clothing tightly to the cylindrical surface in spaced helical convolutions. A segment C is formed in an underside of a base formed by a shoulder and each tooth portion of the metallic card clothing by reason of the set having been applied to such an extent as to cause the metallic card clothing to correspond generally in diameter to the cylindrical surface. A sealant D fills each space defined between the segments and the cylindrical surface so as to present a concave meniscus extending between the cylindrical surface and the base entirely along each side thereof. Thus, fiber entrapment in the space beneath the wire is avoided as well as consequent loading of the beater roll precluded, and the beater roll is readily reclothable.

The beater roll illustrated in FIG. 1 has end flanges 10 and 11 with the smooth cylindrical surface upon which the clothing is surface wound designated at A between flanges. The roll body carries the usual central cylindrical bore 12 therein. A circumferential slot 13 is defined in the cylindrical surface A adjacent each of the flanges 10 and 11 to accommodate an end wire portion 14. The wire portion 14 is confined within the slots 13 by suitable fastening means B which includes a fastening screw having a head 15 and an enlarged threaded portion 16 so that an inner surface of the head will compressibly secure the wire ends 14 in the slots 13 for convenient removal when reclothing the roll.

A segment C is illustrated in the underside of a base portion of the wire formed by the shoulder 16 and the teeth 17 which are narrower and extend up from one side of the shoulder. It will be noted, that the lower base corners are rounded as at 18. The rounded corners 18, together with the space defined by the segments C are instrumental in the loading of the roll by trapping fibers which reach the base of the clothing. Normally, the fibers are carried adjacent the outer portions of the teeth when the roll is serving its opening function so that the abrasion exerted upon the meniscus formed by the sealant D is minimal. The meniscus is illustrated at 19 and extends from the base over the rounded corners 18 to the smooth roll surface A in order to seal the space adjacent the base portion of the wire defined by the irregularities formed by the corner portion of the shoulders and gaps or spaces defined by the segments C producted by the set imparted to the wire during winding upon the roll.

The wire has a tension therein which is between 25% and 50% of the tensile strength of the wire in order to tightly accommodate the wire to the roll body. The set produces an internal diameter of the clothing slightly greater or slightly less than that of the roll body so as to fit tightly when tensioned upon the roll.

When a newly manufactured open end spinning grooveless combing roll is wound or a used roll is rewound with metallic wire clothing, a sealant is applied to the wire and rolls contacting surfaces. The sealant may be any material that will become sufficiently hard and heat-resistant so that contacting fibers will not adhere during the running of the roll. The sealant can be applied in any convenient manner such as by brushing, spraying or wiping. The purpose of the sealant is to fill up any voids, gaps or spaces which exist between the wire base and the roll surface after winding. Such voids are created by the radius on the base corners of the wire and by the non-uniform wrapping of the wire on the roll surface due to the relatively higher wire stiffness under the teeth. It has been found that, these voids if not sealed, trap fibers causing fiber buildup to occur on the roll which, in turn, will generate unevenness in the yarn or prevent the roll from combing at all.

To eliminate these spaces, a sealant is used in the manufacture of grooveless surface wound rolls. A process involves the application of liquid coating or sealant which will flow into the small spaces or crevices, adhere and then harden. This process can be performed during the winding of the metallic clothing on the roll but preferably after winding. In the first instance, the liquid sealant is applied to the roll surface, as by brush or spray. When the wire contacts the roll surface, the liquid sealant migrates, filling the crevices and providing a small meniscus between the wire base and roll surface. In the second instance, the liquid sealant is applied, as by spraying to the wire and the roll surface between the wire strands and is allowed to flow into the crevices beneath the wire and harden.

A number of materials can be used for the liquid sealant; such as, epoxy varnish, polyurethane varnish, acrylic lacquer, nitorcellulose lacquer, and the like. The material should be thin enough to flow into a crevice about 0.001" wide and thick enough to fill voids about 0.010" wide. It must adhere and bond to the coated surfaces and harden into a solid structure which will not become tacky at operating temperatures or react with the fibers and finishes being spun. The sealant must harden in a reasonable amount of time to be compatible with the manufacturing procedure.

A preferred sealant process involves spraying the wound roll surface while slowly rotating the roll with a nitrocellulose lacquer (Type 70 Plastic Spray, Chemie, GmbH) from an aerosol can until the surface becomes wetted. The roll is then laid down on one side to dry so that the sprayed cylindrical surface A is vertical. After the lacquer has dried sufficiently, about 1 hour at 70 degrees F., the roll is resprayed and laid down on the other side to dry or cure. This allows the sealant to flow into and fill the crevices from each side of the wire and form a small meniscus between the wire base and roll surface. The sealant that adheres to the exposed surfaces, such as teeth and roll surfaces, does so in a very thin layer which provides a smoothing effect facilitating roll start-up. The exposed sealants will slowly wear away during use and not affect the spun yarn.

While a preferred embodiment of the invention has been described using specific terms, such description is for illustrative purposes only, and it is to be understood that changes and variations may be made without departing from the spirit or scope of the following claims.

What is claimed is:

1. The method of making a surface wound beater roll for use in open end spinning including the steps of:

winding metallic card clothing about a uniform cylindrical beater roll body in spaced helical convolutions, said wire having a base and teeth extending upwardly therefrom, while placing a set therein causing the wire to conform generally to the surface of the beater roll body;

forming repetitive spaces under said teeth by reason of placing said set in said wire, a segment being formed in an underside of said base under each tooth defining said spaces;

applying a liquid sealant upon the wound roll causing the sealant to flow into said spaces; and allowing the sealant to cure forming a meniscus extending between said cylindrical surface and said base entirely along each side thereof.

* * * * *